US005995779A

United States Patent [19]

Natsume et al.

[11] Patent Number: 5,995,779

[45] Date of Patent: Nov. 30, 1999

[54] IMAGE FORMING APPARATUS FOR REGISTERING A PLURALITY OF PRINT JOBS IN MEMORY AND SELECTING SHEET TRAY ACCORDINGLY

[75] Inventors: Junko Natsume; Hiroshi Sumiyama, both of Aichi-ken; Kazuo Inui, Toyohashi, all of Japan

[73] Assignee: Minolta Co., LTD., Osaka, Japan

[21] Appl. No.: 09/248,152

[22] Filed: Feb. 10, 1999

[30] Foreign Application Priority Data

Feb. 12, 1998 [JP] Japan ..... 10-044243
Dec. 21, 1998 [JP] Japan ..... 10-362085

[51] Int. Cl.[6] ..... G03G 15/00

[52] U.S. Cl. ..... 399/82; 399/391

[58] Field of Search ..... 399/23, 81–83, 399/85, 87, 391, 392

[56] References Cited

U.S. PATENT DOCUMENTS 4,008,957 2/1977 Summers ..... 399/23
4,350,434 9/1982 Paulus et al. ..... 399/81
5,216,472 6/1993 Muto et al. ..... 399/392
5,459,580 10/1995 Suzuki ..... 358/296
5,491,557 2/1996 Nakajima et al. ..... 358/296
5,689,765 11/1997 Nishinozono ..... 399/81

FOREIGN PATENT DOCUMENTS 6-282140 10/1994 Japan .
7-250190 9/1995 Japan .
9-197914 7/1997 Japan .

*Primary Examiner*—Robert Beatty
*Attorney, Agent, or Firm*—Morrison & Foerster LLP

[57] ABSTRACT

An image forming apparatus such as a copying machine which is capable of multi print job is disclosed, the image forming apparatus stores identification information of the recording sheet tray selected by a selection means for each registered print job in memory for each print job. When a recording sheet tray for a new print job is selected, selection of the recording sheet tray for the registered print job stored in memory is inhibited or a notice will be issued. Thereby, the recording sheet tray selected for the preceding print job will not be selected for the subsequent print job.

14 Claims, 16 Drawing Sheets

IMAGE FORMING APPARATUS FOR REGISTERING A PLURALITY OF PRINT JOBS IN MEMORY AND SELECTING SHEET TRAY ACCORDINGLY

BACKGROUND OF THE INVENTION

This application is based on patent applications No. H10-44243 and H10-362085 filed in Japan, the contents of which are hereby incorporated by reference.

1. Field of the Invention

This invention relates to an image forming apparatus, and more particularly relates to an image forming apparatus which registers a plurality of print jobs in memory, reads out the registered print jobs to print on recording sheets.

2. Description of the Related Art

Heretofore, two types of copying apparatus have been known. One is a type of copying apparatus which prints documents set on platen glass and the other is a type of copying apparatus which executes reading of documents and printing separately and can operate printing of a document read previously during reading of the following document.

The latter type of copying apparatus can read the next document during printing of a document read previously. The image data of the next document is stored in memory as a print-waiting print job, and upon completion of printing of the preceding document, the print-waiting print job is read out from the memory and printed.

Therefore, the operator can start copying of the next document without waiting for completion of printing even though the copying apparatus is currently printing the preceding document.

Such a function is called a multi print job function.

On the other hand, a copying apparatus is usually provided with a plurality of recording sheet trays. The recording sheet trays are classified into two types: the first type of recording sheet tray which accommodates recording sheets of a predetermined standard size (A4, B4, etc.) and cannot accommodate recording sheets of other sizes, and the second type of recording sheet tray which can accommodate recording sheets of various sizes.

Recording sheet trays of the second type are of two types: one is universal recording sheet trays which can accommodate many recording sheets and the other one is hand feed recording sheet trays which cannot accommodate so much recording sheets as the former but can easily gain access from the outside for setting recording sheets.

Because the size of a recording sheet to be accommodated can be changed relatively easily in the case of the second type recording sheet trays, recording sheets of various sizes ranging from the standard sizes such as A4, B4, and etc. to non-standard various sizes are used. In particular, because a recording sheet can be set easily in the case of a hand feed recording sheet tray, various types of recording sheets of not only various recording sheet sizes but also recycled recording sheets, color recording sheets, and OHP recording sheets are used.

When a first type recording sheet tray, for which the recording sheet size is not changed easily, holds no desired recording sheet, the operator sets desired recording sheets on a hand feed recording sheet tray or on a universal recording sheet tray, if the quantity is much, and selects the hand feed recording tray or universal recording sheet tray from an operation panel.

When a recording sheets are fed from a hand feed recording sheet tray or a universal recording sheet tray for copying operation using a copying apparatus having the above-mentioned multi print job, the following problem is caused. That is, An operator has set desired recording sheets on a hand feed recording tray, selected the hand feed recording sheet tray, performed document reading, and left from the place without confirming that printing is executed as desired.

After that and before the printing is executed, another operator sets new recording sheets with replacing for the previously set recording sheets and operates copying, then as the result, the documents of the former operator are printed on the recording sheets which are set by the latter operator.

Such a trouble is caused particularly in the case of a hand feed recording sheet tray and a universal recording sheet tray. However, such a trouble can be caused also in the case of first type recording sheet trays described herein above. The trouble is caused not only for copying apparatus but also for other various image forming apparatus such as printers which are connected to plural computers.

SUMMARY OF THE INVENTION

It is an object of the present invention to prevent the problem in using an image forming apparatus such as a copying apparatus having multi print job function as described herein above that a recording sheet set on a recording sheet tray by the former operator is replaced with another recording sheet by the latter operator and the print that the former operator wants to obtain is not obtained.

According to the present invention described hereinafter, identification information of the recording sheet tray selected by the selection means for each registered print job is stored in memory respectively for each print job. When the recording sheet tray for a new print job is selected, selection of the recording sheet tray for the registered print job stored in memory is inhibited.

Thereby, the recording sheet tray which has been selected for the preceding print job is not selected for the subsequent print job.

As the result, recording sheets accommodated in the recording sheet tray selected in the preceding print job is not changed to other recording sheets to be used for the subsequent print job, and the preceding print job is printed always on the desired recording sheet.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such an example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

EMBODIMENT 1

The first embodiment of the present invention will be described in detail hereinafter with reference to the drawings.

In Embodiment 1, a plurality of copying apparatuses is used not only stand-alone but also in connection to a network, and an image is printed by giving an instruction from a personal computer.

Figure 1:
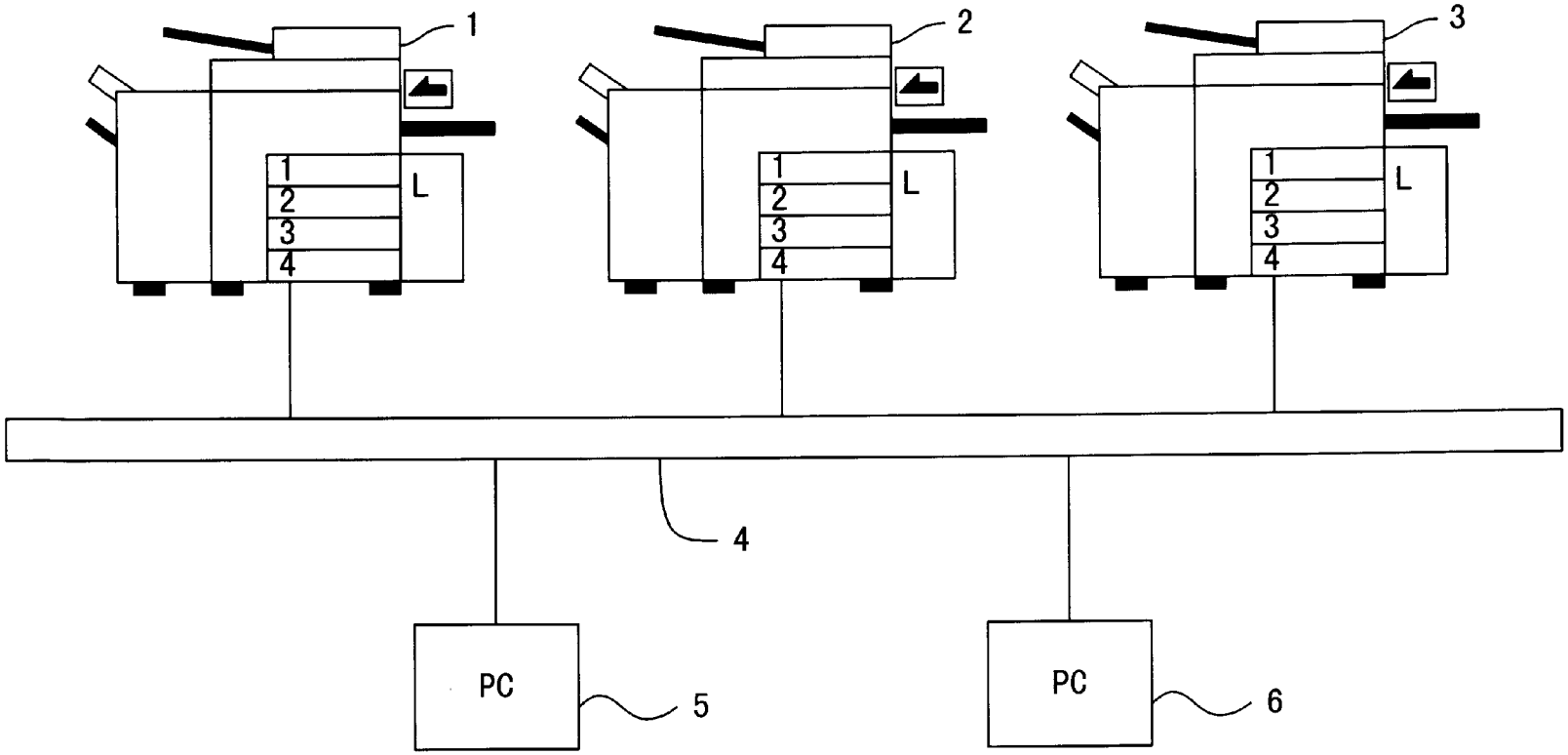
FIG. 1 is a diagram for illustrating the whole structure of a network for connecting copying apparatuses 1, 2, and 3 in accordance with embodiments of the present invention to personal computers.

FIG. 1 is a diagram for illustrating the whole structure of a network which connects copying apparatuses 1, 2, and 3 in accordance with the present invention and personal computers.

The copying apparatuses 1, 2, and 3 are bus-type connected to the personal computers 5 and 6 with a telecommunication line 4. The personal computers 5 and 6 transmit the image data to the copying apparatuses 1, 2, and 3, and the image is printed. Each copying apparatus is provided with an image reading unit IR, and the image data which the image reading unit IR reads a document to obtain can be printed.

The copying apparatuses 2 and 3 may have the same structure and function as the copying apparatus 1.

Figure 2:
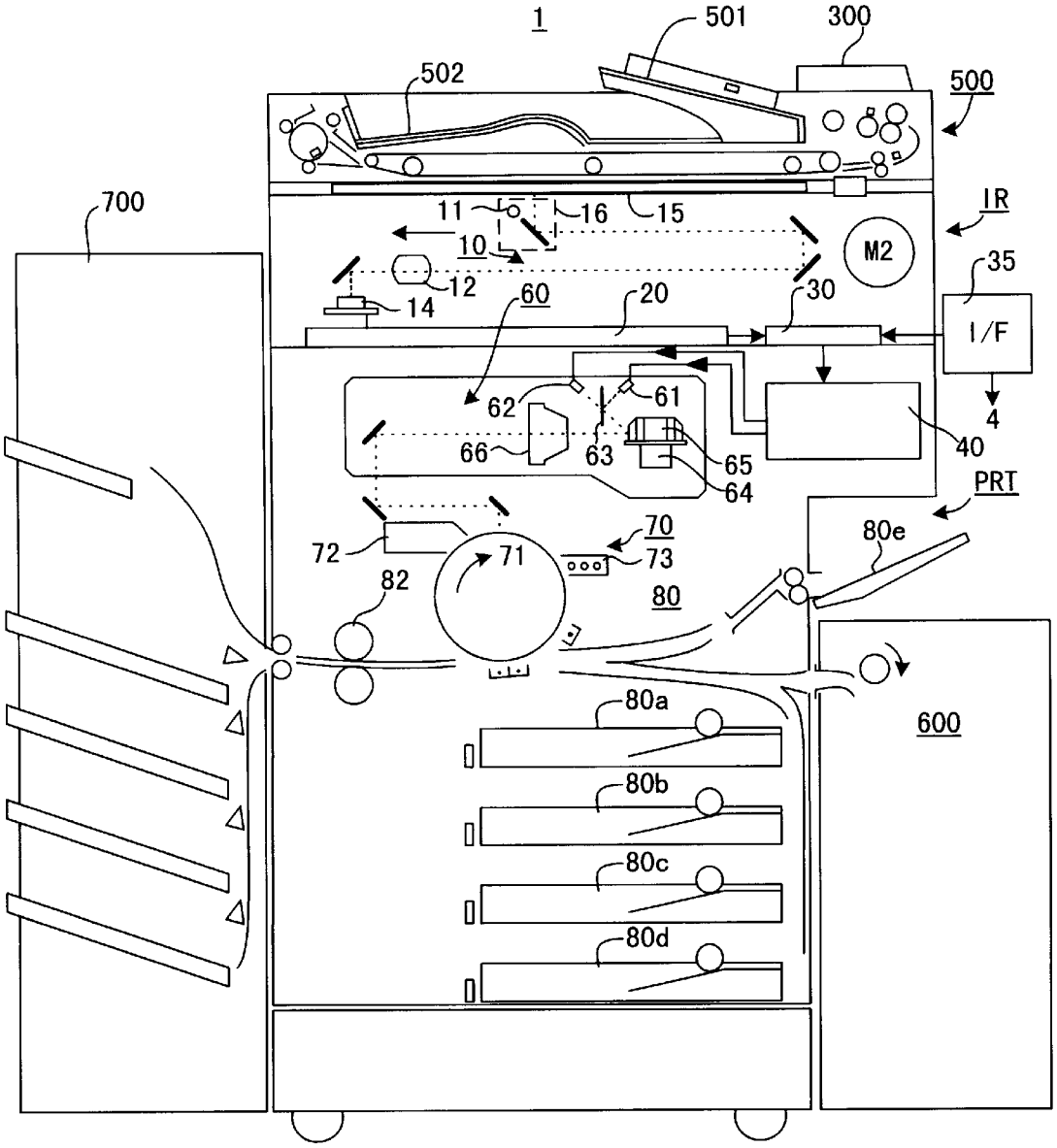
FIG. 2 is a schematic cross sectional view for illustrating the outline structure of the copying apparatus 1.

FIG. 2 is a schematic cross sectional view for illustrating the outline structure of the copying apparatus 1.

The copying apparatus 1 is provided with the image reading unit IR for reading the image of a document and forming the image data, a memory unit 30 for storing the image data obtained by the image reading unit IR temporarily, a printing unit PRT for printing based on the image data stored in memory unit 30, an operation panel 300 for inputting operation instruction, a document feeding unit 500 for feeding a document and reversing a document upside-down, a large capacity sheet tray 600, which is capable of accommodating a lot of recording sheets, for feeding the recording sheet one by one, and a sorter 700 for receiving and sorting printed recording sheets. These operations are controlled by a control unit described hereinafter.

In the document feeding unit 500, a document set on a document stacker 501 is set automatically at the reading position on the platen glass 15 first from the lowermost document when printing is instructed, and discharged on a document discharge tray 502 after completion of reading by the image reading unit IR.

The image reading unit IR comprises a scanning unit 10 and an image signal processing unit 20.

In the scanning unit 10, an exposure lamp 11 attached on a scanner 16 which moves under a document irradiates a light onto the image of the document set at the reading position. The reflected light from the document is irradiated on a photoelectric element 14 comprising a CCD array by way of a reflection mirror and lens 12.

Subsequently, the signal obtained by the scanning unit 10 is sent to the image signal processing unit 20. In the image signal processing unit 20, the input signal is subjected to image processing such as binarization processing, image quality correction, multiplication conversion, and image edition. The image data subjected to image processing is stored in memory unit 30.

The printing unit PRT comprises a print processing unit 40, an optical unit 60, a image forming unit 70, and a recording sheet feeding unit 80.

The print processing unit 40 drives the optical unit 60 based on the image data from the memory unit 30. In the optical unit 60, semiconductor lasers 61 and 62 emit respectively laser beams based on the signal controlled by the print processing unit 40. These laser beams are synthesized by a dichroic mirror 63, reflected by a polygon mirror 65 which is rotated by a motor 64, and irradiated onto a photosensitive drum 71 of the image forming unit 70 through a main lens 66.

In the image forming unit 70, an electrostatic charger 72 charges first the photosensitive drum 71, and the laser beam from the optical unit 60 is irradiated onto the photosensitive drum 71. An electrostatic latent image is formed thereby on the photosensitive drum 71. Subsequently, a developer develops the electrostatic latent image with toner. The toner image on the photosensitive drum 71 is transferred onto a recording sheet fed from recording sheet trays 80*a*, 80*b*, 80*c*, or 80*d* of the recording sheet feeding unit, the large capacity sheet tray 600, or the hand feed recording sheet tray 80*e*. Then, the recording sheet is fed to a fixing unit 82, and the toner is fixed on the recording sheet by heat and pressure, and then the recording sheet is discharged to the sorter 700.

The recording sheet trays 80*a*, 80*b*, and 80*c*, and the large capacity sheet tray 600 are fixed recording sheet trays having specifying plates for specifying peripheral four sides of a recording sheet so that recording sheets of corresponding standard sizes are accommodated therein.

The recording sheet tray 80*d* is a universal recording sheet tray, which has a movable specifying plate for adjusting it correspondingly to the recording sheet size so that recording sheets of various sizes are accommodated.

The hand feed recording sheet tray 80*e* extends to the outside of the copying apparatus and has a movable specifying plate for specifying the side edges of a recording sheet so that recording sheets of various standard sizes and non-standard sizes can be used. The hand feed recording sheet tray 8*e* allows an operator to easily feed special recording sheets such as OHP recording sheets, thick sheets, and color recording sheets, which are used not so often, other than recording sheets which are set in the recording sheet trays 80*a*, 80*b*, 80*c*, and 80*d*.

The copying apparatus 1 has a telecommunication interface 35. The copying apparatus 1 can communicates the image data with outside apparatuses such as the personal computers 5 and 6 and copying apparatuses 2 and 3 though the telecommunication line 4 of the network as shown in FIG. 1 by means of the telecommunication interface 35.

Figure 3:
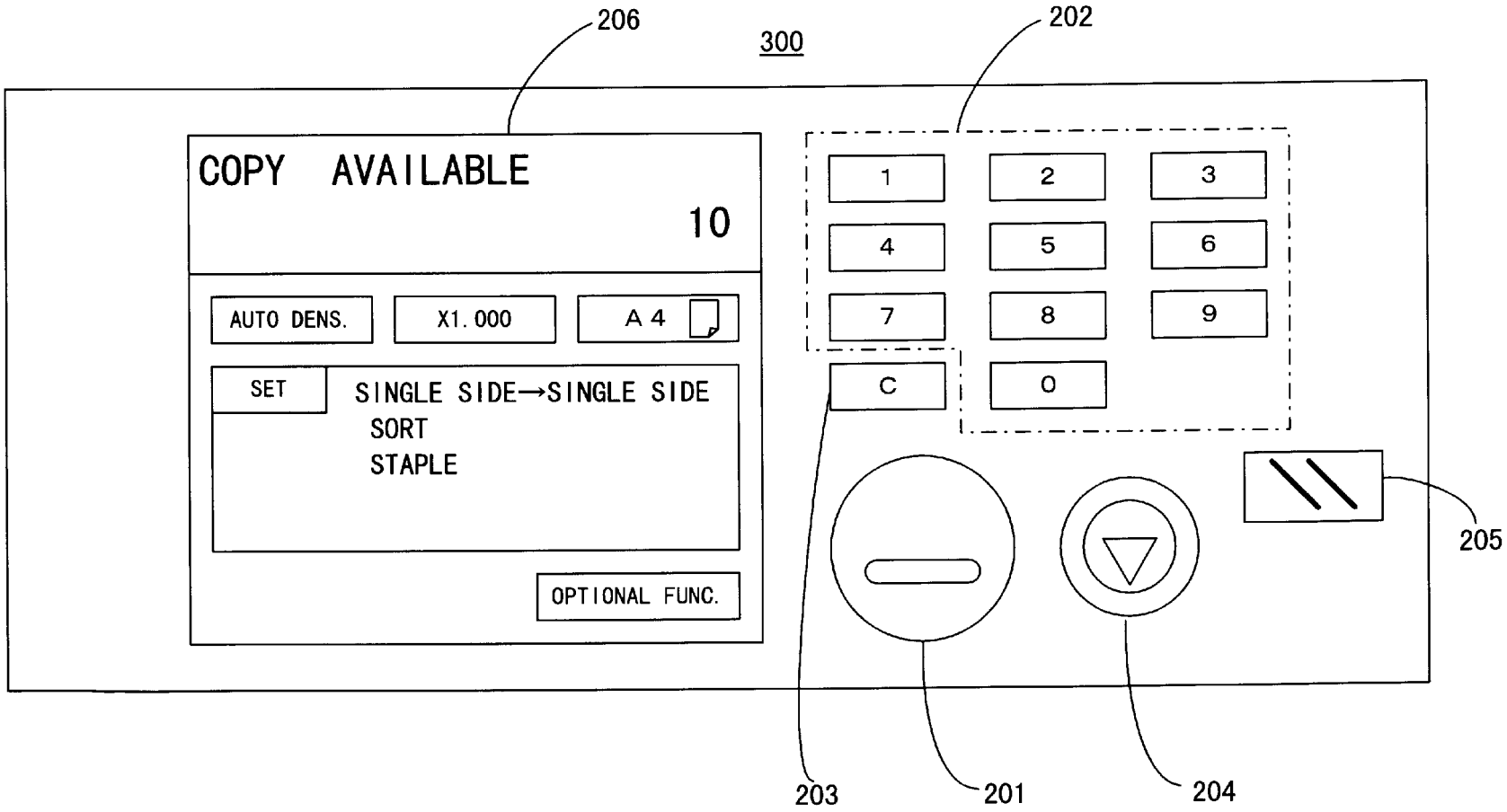
FIG. 3 is a front view of an operation panel 300 of an image forming apparatus.

FIG. 3 shows a front view of the operation panel 300 of the image forming apparatus.

201 represents a start key for indicating operation starting, 202 represents a ten key for entering numeric values such as the number of copies, 203 represents a clear key for clearing entered numeric values, 204 is a stop key for indicating operation stop, 205 represents a panel reset key for canceling the set mode and print job, and 206 represents an LCD display unit for displaying various modes having a touch panel on the surface, which is served to enter various key input by touching keys displayed on the LCD display unit 206.

Figure 4:
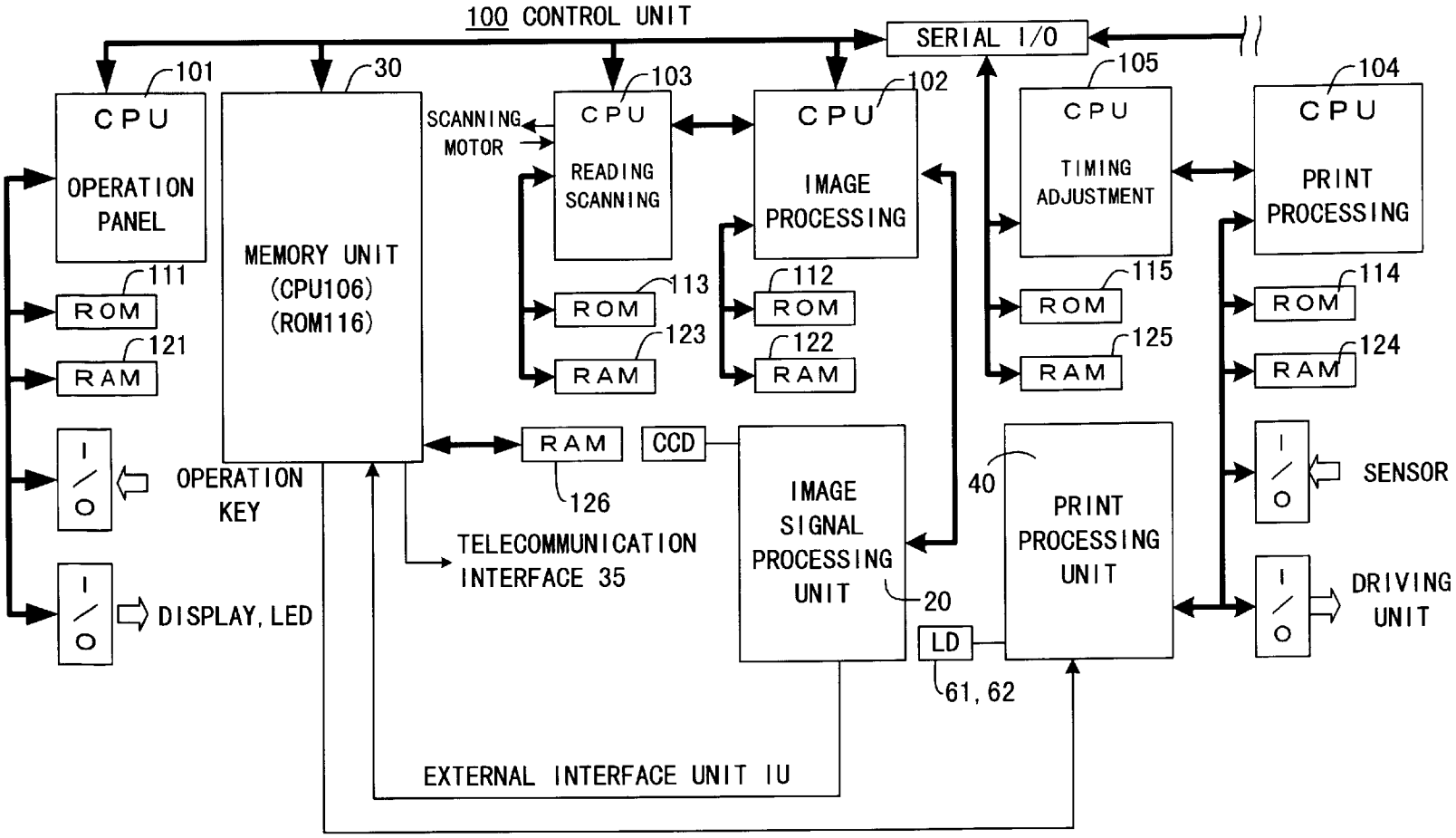
FIG. 4 is a block diagram for illustrating the structure of a control unit 100 of the copying apparatus 1 as well as FIG. 5.
Figure 5:
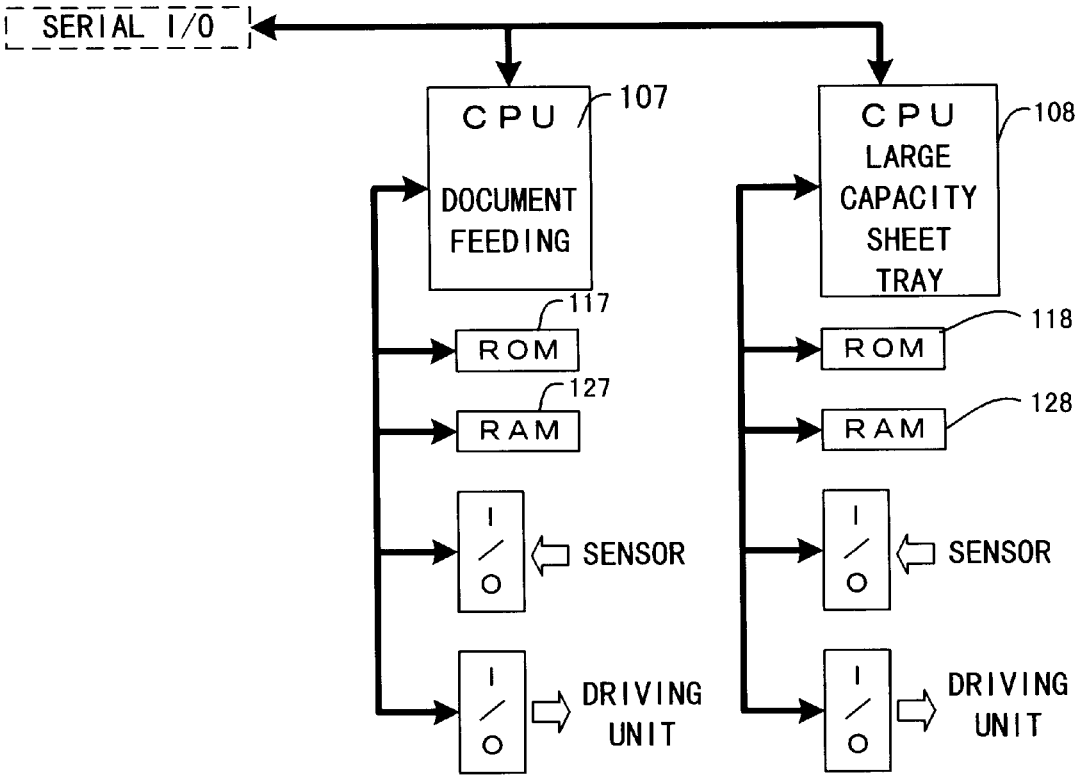
FIG. 5 is a block diagram for illustrating the structure of the control unit 100 of the copying apparatus 1 as well as FIG. 4.

Next, the control unit 100 is described. FIG. 4 and FIG. 5 are block diagrams for illustrating the structure of the control unit 100 of the copying apparatus 1.

The control unit 100 mainly comprises 8 CPU's 101 to 108, CPU's 101 to 108 are provided respectively with ROM's 111 to 118 which respectively store programs and RAM's 121 to 128 which are served to be work areas for operating programs. CPU 106 and ROM 116 are provided in memory unit 30.

The CPU 101 controls input and display of a signal from various operation keys of the operation panel 300. The CPU 102 control components of the image signal processing unit 20 and the CPU 103 controls driving of the scanning unit 10. The CPU 104 controls the print processing unit 40, optical unit 60, and image forming unit 70, and the CPU 105 controls timing adjustment of the whole control unit 100 and processing for setting operation mode.

The CPU 106 stores the image data which is read by controlling the memory unit 30 in memory temporarily, reads out it, and delivers it to the print processing unit 40. Thereby, the CPU 106 controls the image reading unit IR and printing unit PRT independently to improve copying speed. The telecommunication interface 35 is connected to the CPU 106 through the network as shown in FIG. 1 to communicate the data with outside apparatuses.

The CPU 107 controls the document feeding unit 500, and the CPU 108 controls the large capacity sheet tray 600. The data is communicated between these CPUs 101 to 108 by way of serial communication by an interrupt.

Figure 6:
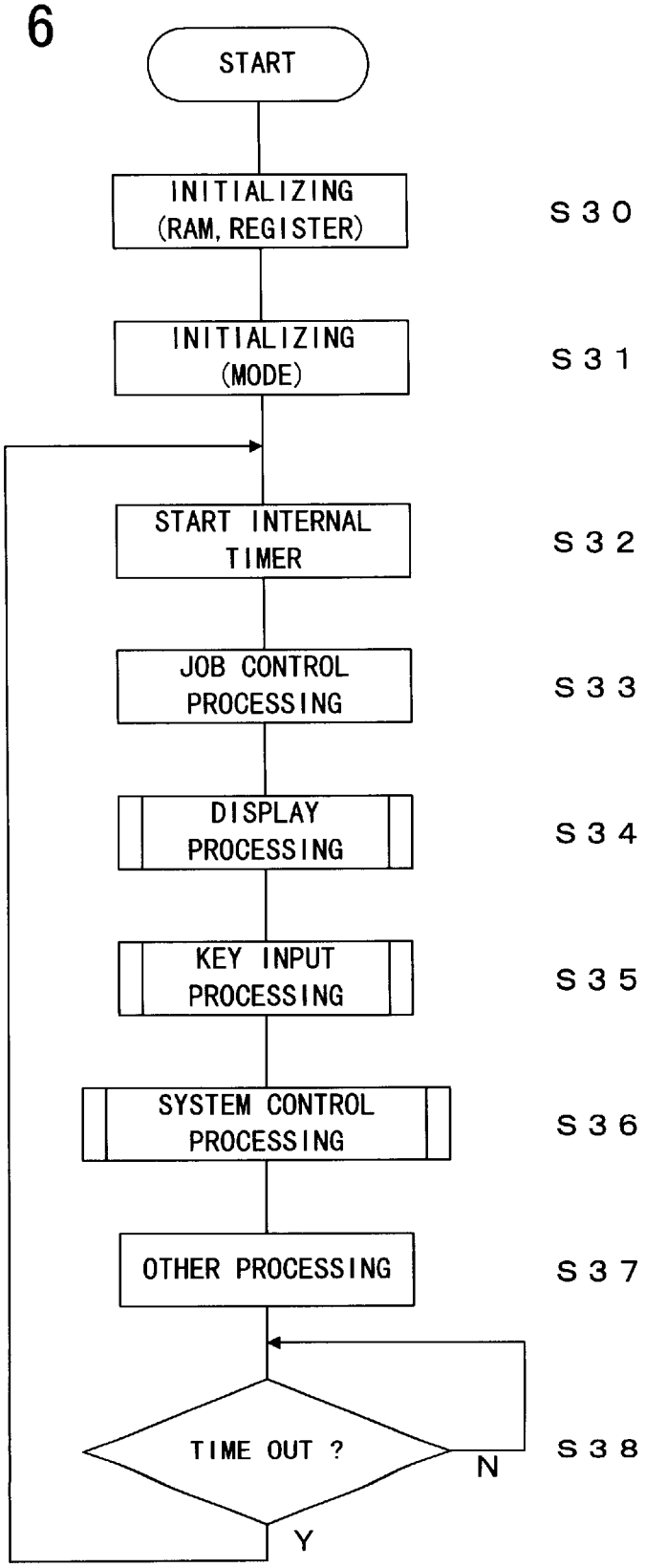
FIG. 6 is a flowchart for describing the procedure for controlling interface and machine operation performed by a CPU 101.

FIG. 6 is a flowchart for describing control sequence of the user interface and machine operation performed by the CPU 101.

When the CPU 101 is reset and the program starts, the CPU 101 initializes the RAM and various registers at step S30 and initializes mode of the copying apparatus at step S31.

The CPU 101 sets the internal timer thereof for repeating period of the main routine containing steps S32 to S38 at step S32 and subsequently executes print job controlling processing for determining current print job at step S33, display processing of the LCD display unit 206 of the operation panel 300 at step S34, key input processing of the hardware keys and the touch panel at step S35, system control processing for controlling machine operation at step S36, and other processing at step S37 in sequence.

At step S38, CPU 101 repeats checking of the internal timer until time out of the internal timer is detected and returns to step S32.

Figure 7:
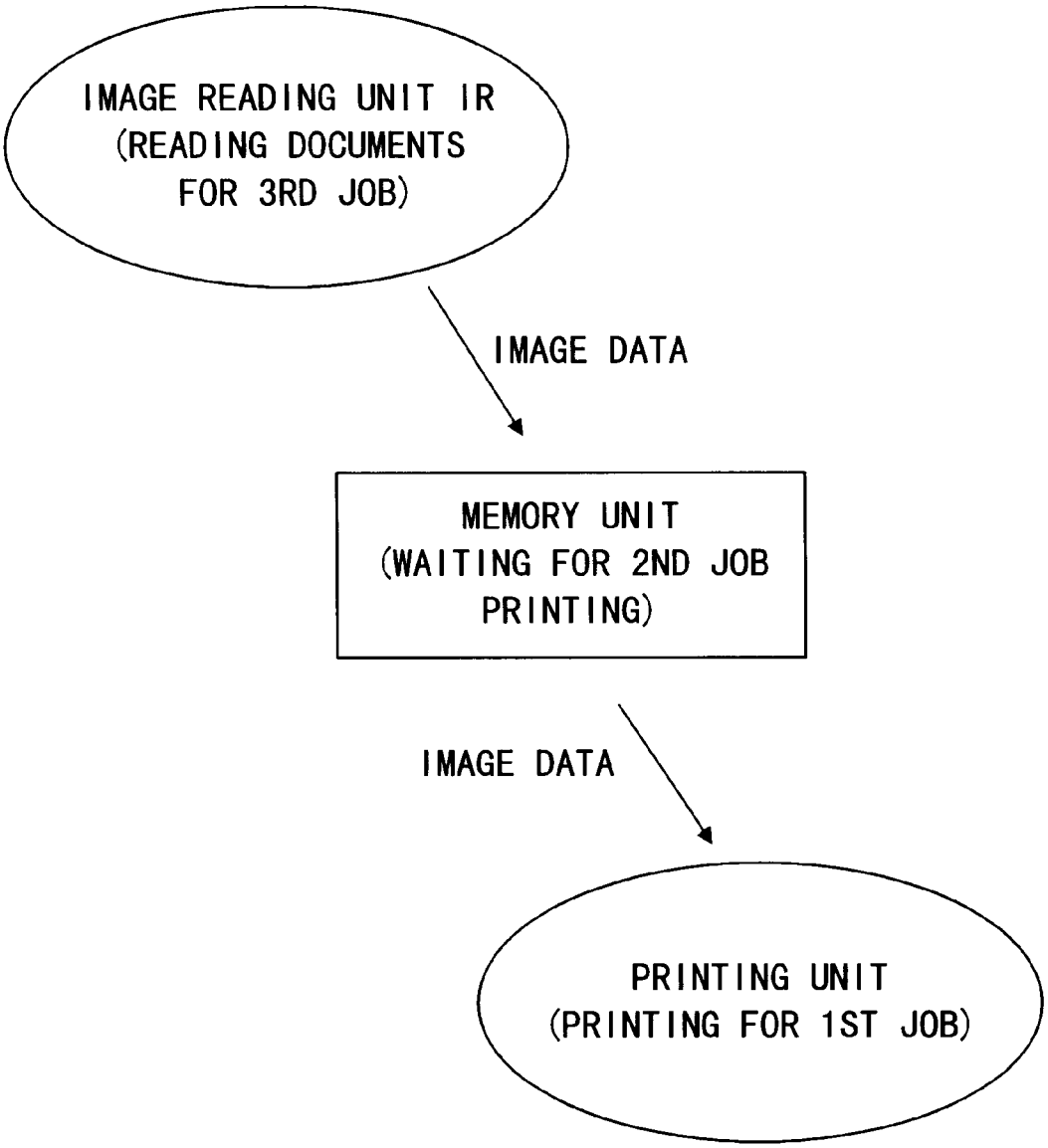
FIG. 7 is a diagram for illustrating the outline of multi print job operation.

FIG. 7 is a schematic diagram for describing multi print job operation.

The multi print job means the operation that the reading unit IR reads a new one document image or receives a new image data from the network in response to a reservation setting from the operation panel 300 and stores the new document image or new image data in the image memory while the printing unit PRT is printing the one document image in the image memory in the digital copying apparatus having the image memory (RAM 126 in memory unit 30)

In detail, in the multi print job, while the printing unit PRT is printing the first print job, the image reading unit IR reads the second or third print job which is the image data group independent from the first print job, or receives and stores the image data from the network. As described herein above, a plurality of print jobs is performed simultaneously in parallel.

In this embodiment, an image data to be printed and the corresponding information indicating which recording sheet tray should be selected from among the recording sheet trays 80*a*, 80*b*, 80*c*, and 80*d*, the large capacity sheet tray 600, and the hand feed recording sheet tray 80*e* as the recording sheet tray to feed a recording sheet on which the image data is to be printed are stored correspondingly each other in the RAM 126 respectively for a plurality of print jobs which are waiting for printing.

Figure 8:
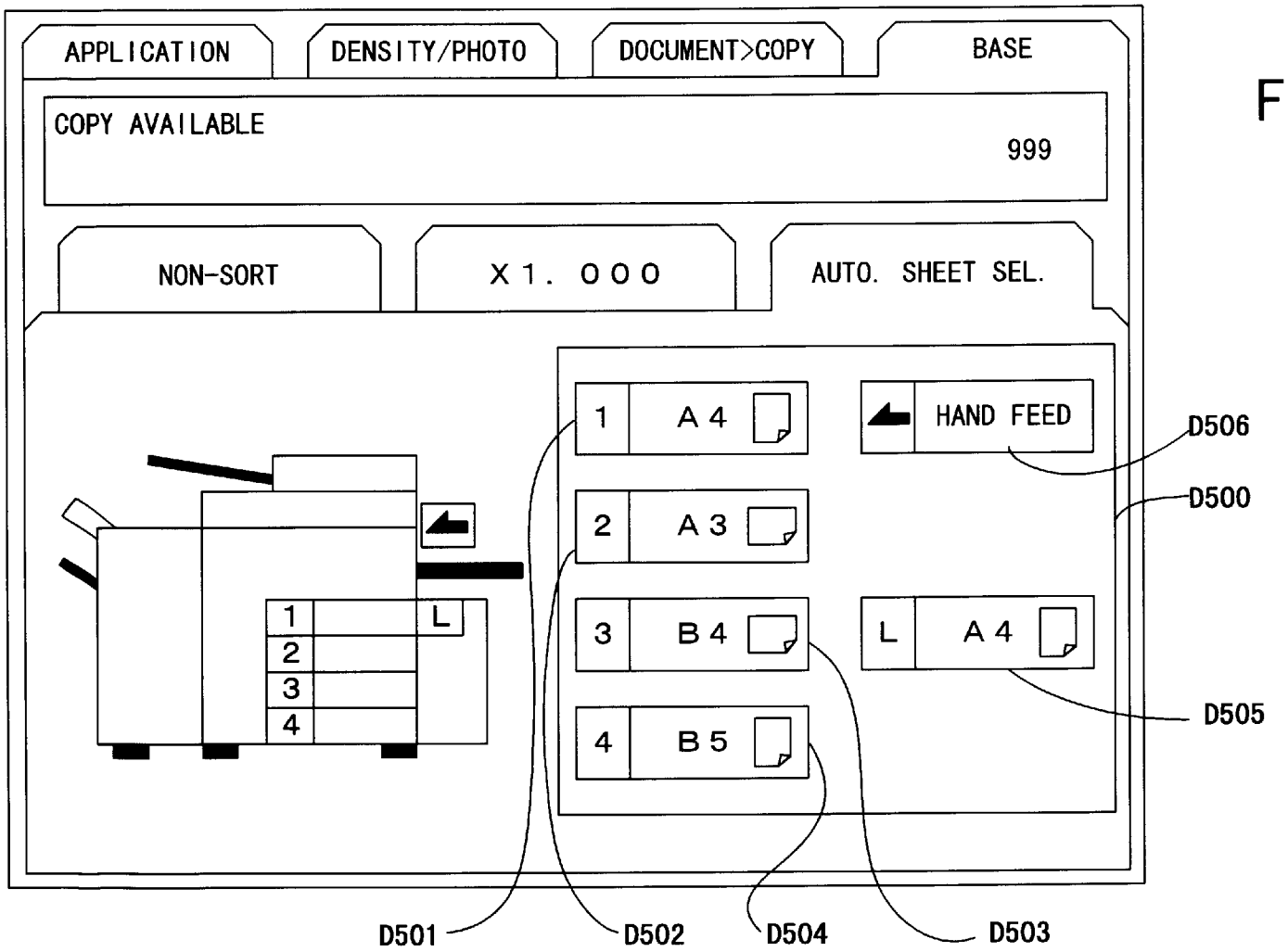
FIG. 8 is a picture for recording sheet selection displayed on a LCD display unit 206.

FIG. 8 is a picture for selecting the recording sheet size displayed on the LCD display unit.

D500 is a picture frame which contains the recording sheet key for selecting a recording sheet tray of the image forming apparatus.

In the frame D500, D501 is a key display for selecting the recording sheet tray 80*a*, and the recording sheet tray 80*a* is selected as the recording sheet tray used for this print job by touching it on the touch panel. Similarly, D502, D503, D504, D505, and D506 are key displays for selecting respectively the recording sheet trays 80*b*, 80*c*, and 80*d*, the large capacity sheet tray 600, and the hand feed recording sheet tray 80*e*, the respective recording sheet trays are selected by touching on the touch panel.

The key displays on the picture display displayed on the touch panel, namely D501, D502, D503, D504, D505, and D506 are respectively referred to as recording sheet key 1, recording sheet key 2, recording sheet key 3, recording sheet key 4, recording sheet key 5, and recording sheet key 6 hereinafter.

Figure 9:
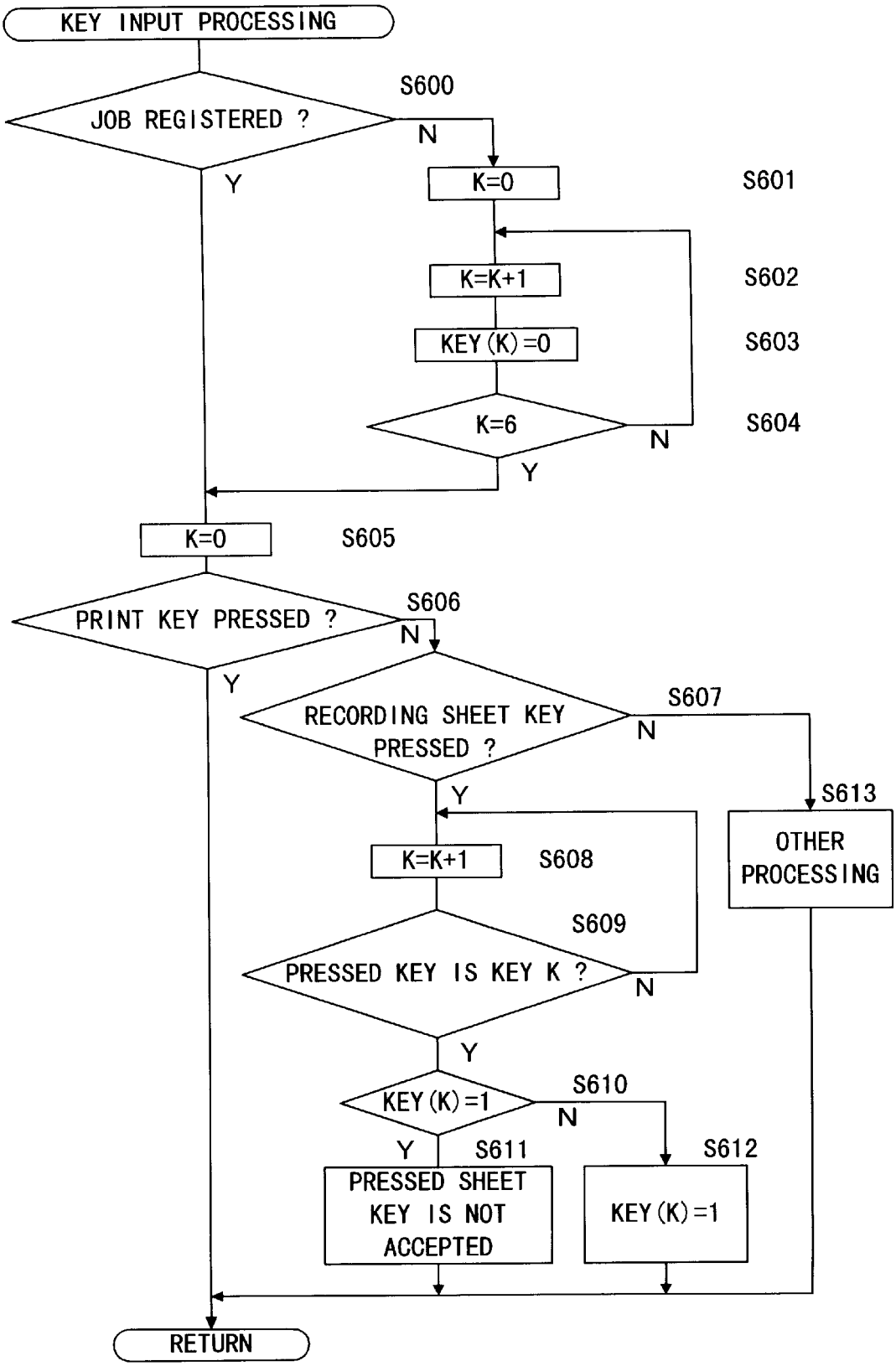
FIG. 9 is a flowchart for describing the key input processing (S35) subroutine in the flowchart shown in FIG. 6 (Embodiment 1).

FIG. 9 is a flowchart for describing key input processing (S35) subroutine in the flowchart shown in FIG. 6.

First, it is determined whether there is any registered print job (in multi print job state), or whether there is any print job image data which is waiting for printing in the RAM 126 (step S600).

If there is no registered print job, a variable K which indicates the KEY number is substituted with 0 (step S601). Next, 1 is added to the variable K (step S602), and 0 is set to the flag KEY (K) (step S603). This operation is repeated until K attains to 6 (step S604). Herein, the flag KEY (K) (flag KEY (1) to KEY (6)) is a flag which is set to 1 when the recording sheet key K is selected and is set to 0 otherwise in any one of registered print jobs.

In other words, because there is no registered print job in the step S601 to step S604, flags KEY (1) to KEY (6) are cleared to 0.

After completion of the above-mentioned processing S601 to S604 or if there is a registered print job (YES in the step S600), the sequence proceeds to the step S605 and the variable K is substituted with 0.

Next, if the print key 201 has been pressed (YES in the step S606), the sequence proceeds to return to execute the print job.

If the print key 201 has not been pressed, it is determined whether a recording sheet key has been pressed (step S607), and if the recording sheet key has not been pressed (NO in the step S607), other processes are operated and the sequence proceeds to return (step S613)

If the recording sheet key has been pressed (YES in the step S607), 1 is added to the variable K (step S608), and it is determined whether the recording sheet key pressed is the recording sheet key K (step S609).

If the recording sheet key pressed is not the recording sheet key K, the sequence returns to the step S608 and repeats this processing. Thereby, what recording sheet key has been selected and pressed to select a recording sheet tray for the print job to be executed out of the recording sheet key 1 to recording sheet key 6 is determined.

After identification of the recording sheet key pressed in the above-mentioned steps S608 and S609, it is determined whether the flag KEY (K) corresponding to this identified recording sheet key K is 1 (step S610). In other words, it is determined whether the recording sheet key K which is pressed now has been selected for the print job registered already in the RAM 126.

If the recording sheet key K which is pressed has not been selected for the registered print job (NO in the step S610), the input of the recording sheet key K is accepted, and 1 is set to indicate that the flag KEY (K) is selected.

If the recording sheet key K pressed is selected for the registered print job (YES in the step S610), the input of the recording sheet key K is not accepted. In other words, the recording sheet key selected in the print job registered already will not be selected for a new print job.

As a method for inhibiting selection of a recording sheet tray which has been selected for the registered print job when a new print job is reserved, alternatively a method for inhibition of such selection in which the recording sheet key selected for the print job registered already is not displayed in the picture on the LCD display unit 206 may be used, instead of the above-mentioned method in which the recording sheet key selected in the print job registered already is not accepted.

Further alternatively, a method in which the recording sheet key selected for the print job registered already is displayed differently from other acceptable recording sheet keys to give attention to an operator and the input is not accepted may be used.

EMBODIMENT 2

Embodiment 2 describes the case that selection of the hand feed recording sheet tray is inhibited in a new print job when the hand feed recording sheet tray has been selected for the print job registered already.

Figure 10:
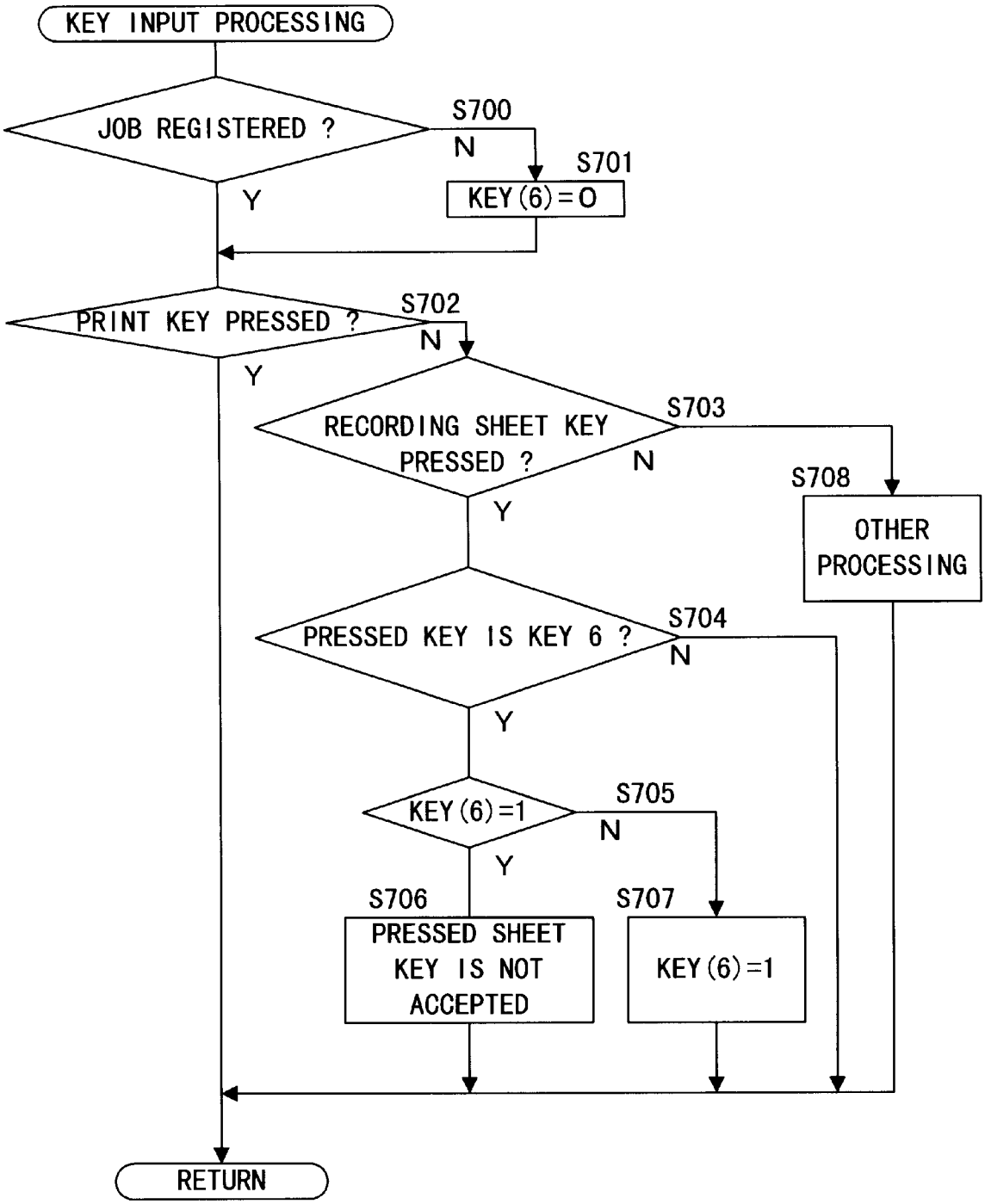
FIG. 10 is a flowchart for describing the key input processing (S35) subroutine in the flowchart shown in FIG. 6 (Embodiment 2).

In embodiment 2, control shown in the flowchart shown in FIG. 10 is operated instead of the flowchart shown in FIG. 9 for embodiment 1. Others are the same as embodiment 1 and description is omitted.

First, it is determined whether there is a registered print job (in multi print job state), that is, whether a print job image data which is waiting for printing is stored in the RAM 126 (step S700).

If there is no registered print job, the flag KEY (6) corresponding to the recording sheet key 6 which selects the hand recording sheet tray 80*e* is set to 0 (step S701).

Next, if the print key 201 is not pressed (NO in the step S702), it is determined which recording sheet key is pressed out of recording sheet key 1 to recording sheet key 6 (step S703), and if a recording sheet key is not pressed (NO in the step S703), other processes are operated, and the sequence proceeds to return (step S708).

If a recording sheet key is pressed (YES in the step S703), it is determined whether the recording sheet key which is pressed is the recording sheet key 6 (step S704).

If the recording sheet key pressed is not the recording sheet key 6, that is, in the case that the recording sheet key pressed is any one of the recording sheet key 1 to recording sheet key 5, the key input is accepted and the sequence proceeds to return.

If the recording sheet key pressed is the recording sheet key 6, it is determined whether the flag KEY (6) is 1 (step S705). If the flag KEY (6) is 1, that is, the recording sheet key 6 which has been selected already in the registered print job, the input of the recording sheet key 6 pressed is not accepted and the sequence proceeds to return (step S706).

If the flag KEY (6) is 0, the input of the recording sheet key 6 is accepted, the flat KEY (6) is set to 1 to indicate that the recording sheet key 6 has been pressed already and the sequence proceeds to return (step S707)

In embodiment 2, a key input for selecting the hand feed recording sheet tray for a new print job is not accepted when the hand feed recording sheet tray has been already selected for the registered print job.

Alternatively for the case that the hand feed recording sheet tray has been already selected for the registered print job, a method for selection inhibition in which the recording sheet key for selecting the hand feed recording sheet tray is not displayed in a picture of recording sheet selection for a new print job to inhibit selection of this recording sheet key may be used. Further alternatively, another method in which the recording sheet key for selecting the hand feed recording sheet tray is displayed differently from other keys to give a notice to an operator and the key input is not accepted may be used.

Further in embodiment 2, the method in which selection of the hand feed sheet recording sheet tray is inhibited is described, however alternatively, a method in which the universal recording sheet tray (the recording sheet tray 80*d*) is inhibited to be selected for a new print job, instead of the hand feed recording sheet tray, when the universal recording sheet tray which has been already selected for the registered print job may be used.

EMBODIMENT 3

Embodiment 3 describes the case that a notice is given to an operator when the recording sheet tray which has been selected already for the registered print job is selected in a new print job.

Figure 11:
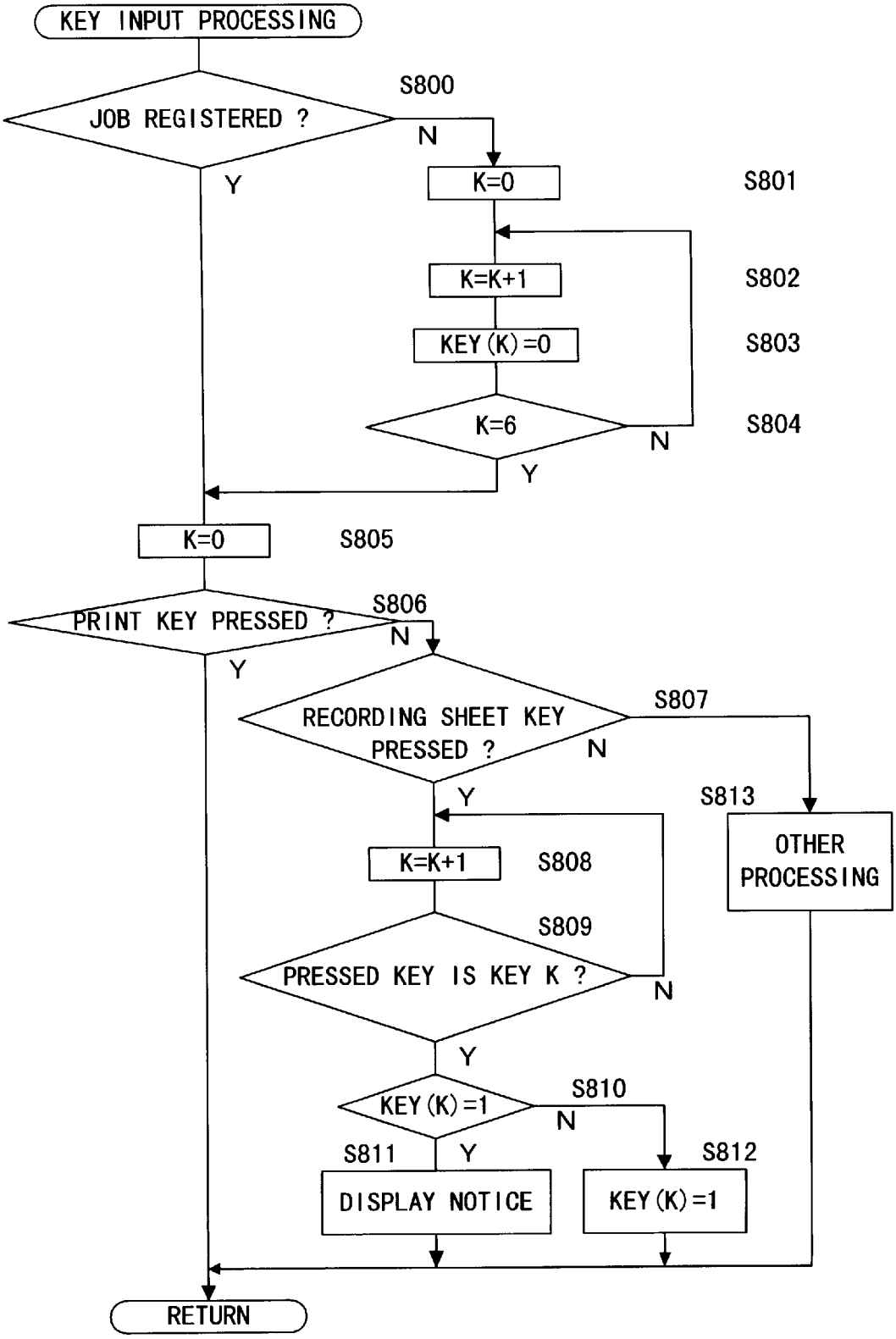
FIG. 11 is a flowchart for describing the key input processing (S35) subroutine in the flowchart shown in FIG. 6 (Embodiment 3)

In embodiment 3, control shown in the flowchart in FIG. 11 is operated instead of the flowchart shown in FIG. 9 for embodiment 1.

In the flowchart shown in FIG. 11, processing other than the step S811 is the same as those of embodiment 1, and description is omitted.

In the step S811, input of the recording sheet key K pressed is accepted, and a notice is displayed on the LCD display unit 206.

The notice says, for example, a message "Recording sheet cannot be changed. Select another recording sheet tray if the recording sheet is wanted to be changed". In detail, the copying apparatus indicates to an operator to select another recording sheet tray if another recording sheet is wanted to be set instead of the recording sheet now accommodated in the selected recording sheet tray. Thereby, it is prevented that another recording sheet is set in the recording sheet tray which has been already selected for the registered print job.

EMBODIMENT 4

Embodiment 4 describes the case that, when the same recording sheet tray as that has been selected already for the registered print job is wanted to be used, selection of the recording sheet tray is accepted on condition that the same recording sheet is used.

Figure 12:
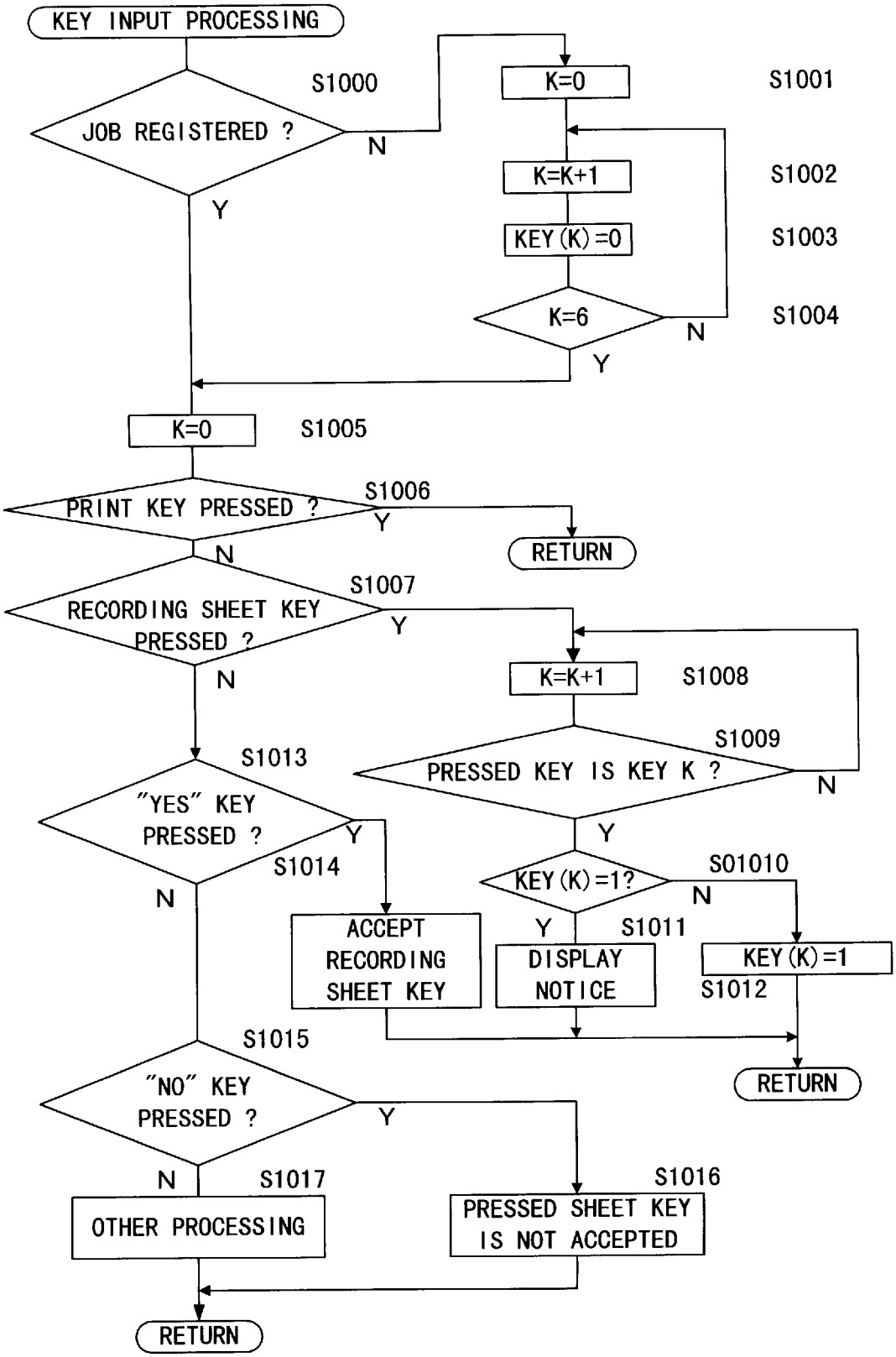
FIG. 12 is a flowchart for describing the key input processing (S35) subroutine in the flowchart shown in FIG. 6 (Embodiment 4)

In embodiment 4, the flowchart shown in FIG. 12 is operated instead of the flowchart shown in FIG. 9 for embodiment 1. Other steps are the same as those operated in embodiment 1 and description is omitted.

First, it is determined whether there is a registered print job (in multi print job condition), namely whether the print job image data which is waiting for print job is stored in the RAM 126 (step S1000).

If there is no registered print job, 0 is substituted in the variable K which indicates the KEY number (step S1001) Next, 1 is added to the variable K (step S1002), and the flag KEY (K) is set to 0 (step S1003). This process is repeated until the variable K attains to 6. Herein, flags KEY (K) (KEY (1) to KEY (6)) are flags, that is 1 if the recording sheet key K has been selected for the registered print job and on the other hand that is 0 otherwise.

In other words, because there is no registered print job in the step S1001 to the step S1004, flags KEY (1) to KEY (6) are cleared to 0.

After completion of the above-mentioned S1001 to S1004, or if there is a registered print job (YES in the step S1000), the sequence proceeds to the step S1005, and 0 is substituted in the variable K.

Next, if the print key 201 has been pressed (YES in the step S1006), the sequence proceeds to return to execute print job.

If the print key 206 has not been pressed, it is determined which recording sheet key has been pressed (step S1007).

If a recording sheet key has been pressed (YES in the step S1007), 1 is added to the variable K (step S1008), and it is determined whether the pressed recording sheet key is a recording sheet key K (step S1009).

If the pressed recording sheet key is not a recording sheet key K, the sequence returns to the step S1008, and this process is repeated. Thereby, what recording sheet key out of recording sheet key 1 to recording sheet key 6 corresponds to the recording sheet key is pressed for recording sheet tray selection of a new print job is determined.

After identification of the pressed recording sheet key in the above-mentioned steps S1008 and S1009, it is determined whether the flag KEY (K) corresponding to this identified recording sheet key K is 1 (step S1010). In other words, it is determined whether the pressed recording sheet key K has been selected in the print job registered already in the RAM 126.

If the pressed recording sheet key K has not been selected for the registered print job (NO in the step S1010) the input of the recording sheet key K is accepted and set to the value of 1 which indicates that the flag KEY (K) is selected.

If the pressed recording sheet key K has been selected for the registered print job (YES in the step S1010), the input of the recording sheet key K is not accepted and a notice is displayed on the LCD display unit 206. In other words, the recording sheet key which has been selected for the registered print job cannot be selected at the present stage.

The notice display asks whether the same recording sheet as recording sheets accommodated in the selected recording sheet tray is used without change, for example, "The recording sheet cannot be changed. Recording sheets accommodated in the selected recording sheet tray is used? YES/NO".

Figure 13:
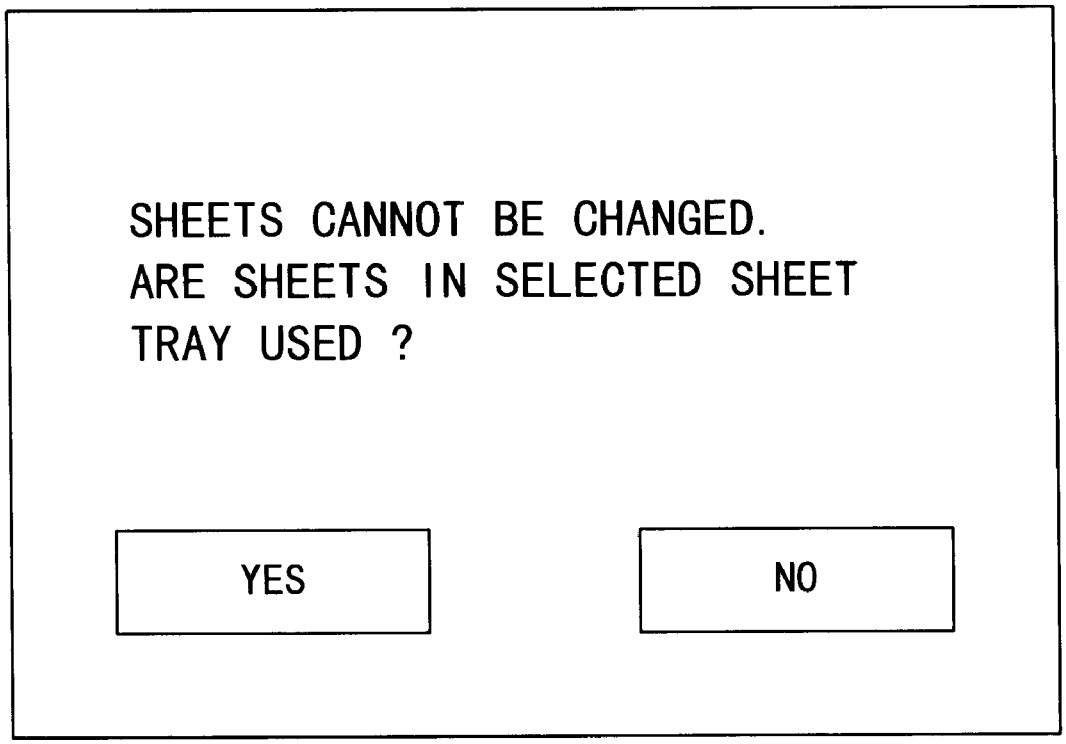
FIG. 13 is a picture of notice display in the Embodiment 4.

On the other hand, if a recording sheet key has not been pressed (NO in the step S1007), it is determined whether "YES" key in the notice display picture shown in FIG. 13 is pressed (step S1013).

If "YES" key is pressed, recording sheets in the selected recording sheet tray is to be used without change, the input of the pressed recording sheet key identified in the steps S1008 and S1009 is accepted (step S1014) and the sequence proceeds to return.

If "YES" key is not pressed (NO in the step S1013) it is determined whether "NO" key in the notice display picture is pressed (step S1015).

If "NO" key is pressed, recording sheets in the selected recording sheet tray is not to be used but another recording sheets will be used with change, the pressed recording sheet key identified in the process of the steps S1008 and S1009 is not accepted and the sequence proceeds to return (step S1016).

If "NO" key is not pressed (NO in the step S1015), other processes are operated and the sequence proceeds to return (step S1017).

Thereby, it is prevented that another recording sheet for another print job is set to the recording sheet tray which has been selected already in the registered print job.

EMBODIMENT 5

Embodiment 5 describes the case that, when the recording sheet tray which has been selected already for the registered print job is selected for a new print job, a notice is displayed and the operation is brought to a stop when the new print job is started.

Figure 14:
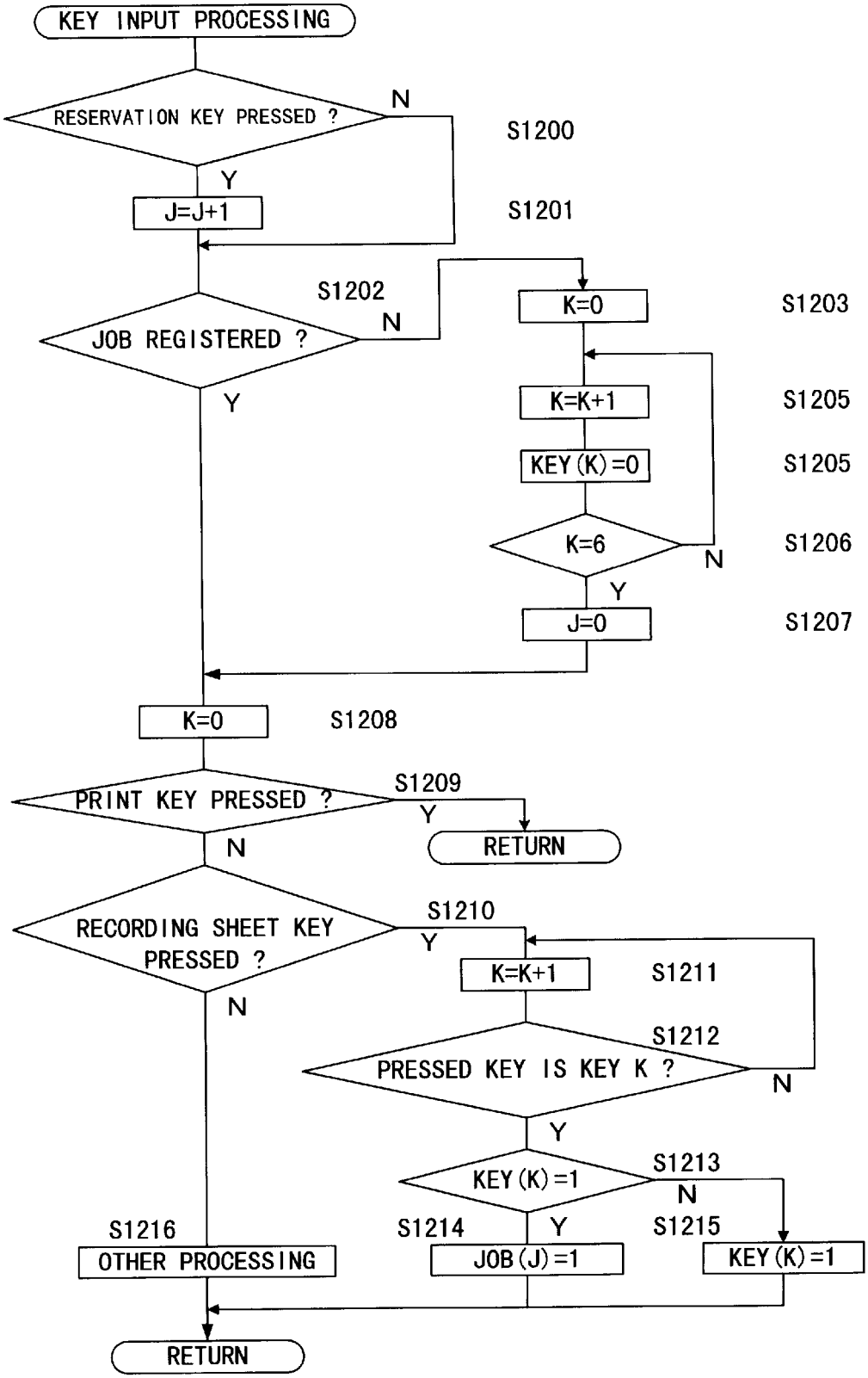
FIG. 14 is a flowchart for describing the key input processing (S36) subroutine in the flowchart shown in FIG. 6 (Embodiment 5).
Figure 15:
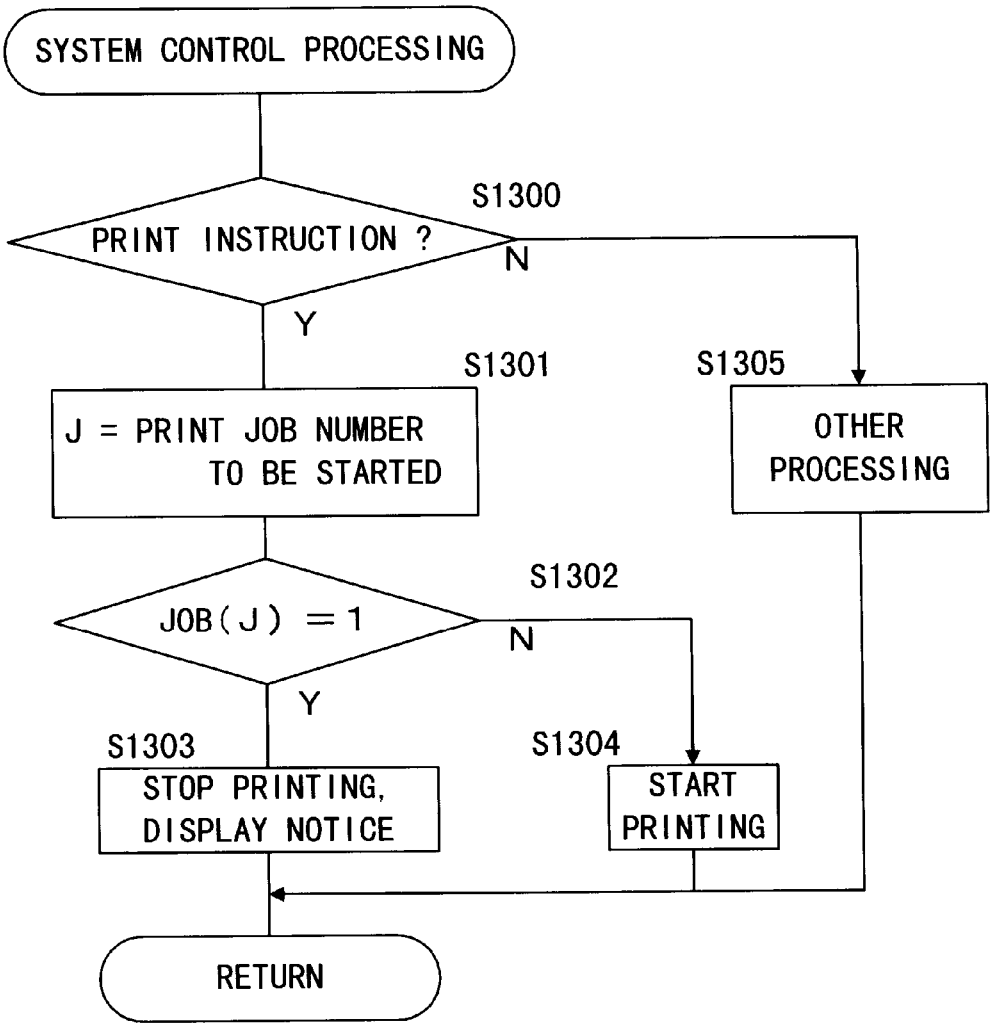
FIG. 15 is a flowchart for describing the "system control processing" (S36, in FIG. 6) subroutine.

In embodiment 5, control shown in the flowchart of FIG. 14 is operated instead of the flowchart of FIG. 9 in embodiment 1. In embodiment 5, the system control processing shown in FIG. 6 in embodiment 1 is different, a flowchart of this subroutine is shown in FIG. 15 and described. Other operations are the same as those described in embodiment 1, and description is omitted.

Figure 16:
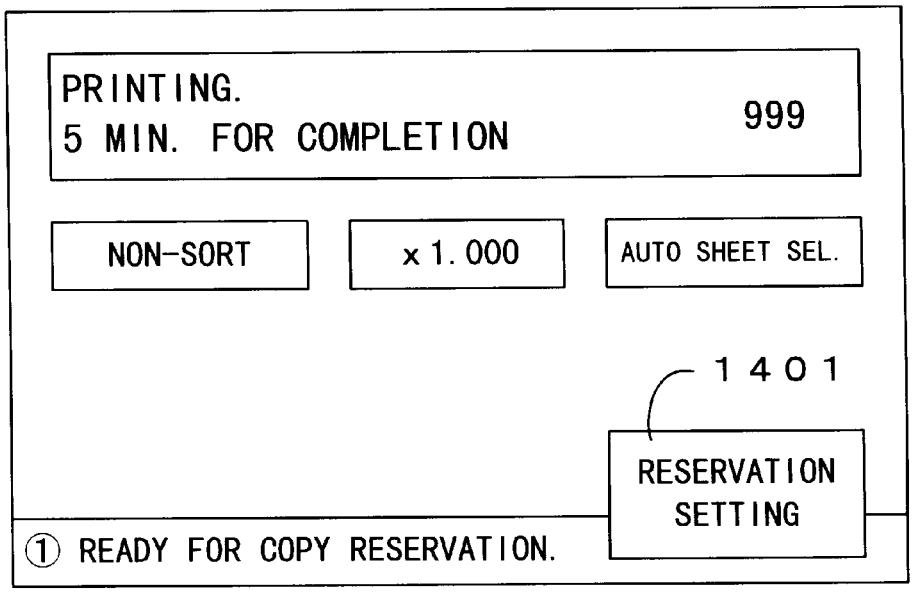
FIG. 16 is a picture displayed on the LCD display unit 206 in Embodiment 5, reservation of a new print job is started by pressing a reservation key 1401.

First, in FIG. 14, it is determined whether the reservation key 1401 shown in FIG. 16 has been pressed (step S1200).

FIG. 16 is a picture displayed on the LCD display unit 206, the reservation key 1401 appears in the picture only when the reservation is acceptable, reservation of a new print job is started by pressing this key. Alternatively for the reservation key 1401 in the picture, a hard key provided on the operation panel 300 may be used as the reservation key.

If the reservation key 1401 has been pressed (YES in the step S1200), 1 is added to the variable J which indicates the number of registered print jobs (step S1201), and the sequence proceeds to the step S1202. If the reservation key 1401 has not been pressed (NO in the step S1200), the sequence proceeds to the step S1202.

Next, it is determined whether there is a registered print job (in the multi print job condition), namely whether the image data of a print job which is waiting for printing is stored in the RAM 126 (step S1202).

If there is no registered print job, 0 is substituted in the variable K which indicates Key number (step S1209).

Next, 1 is added to the variable K (step S1204), and the flag KEY (K) is set to 0 (step S1205). This process is repeated until the variable K attains to 6. Herein, flags KEY (K) (KEY (1) to KEY (6)) are variables, that is 1 if it is selected in the print job in which the recording sheet key K is registered and that is 0 otherwise.

In other words, because therein no registered print job in the step S1203 to step S1206, flags KEY (1) to KEY (6) are cleared to 0.

In the step S1207, because it was determined in the step S1202 that there was no registered print job, the variable J which indicates the number of the registered print jobs is set to 0.

After completion of the above-mentioned S1203 to S1207, or if there is a registered print job (YES in the step S1202), the sequence proceeds to the step S1208, and 0 is substituted in the variable K.

If the pressed key is a print key in the step S1209, the sequence proceeds to return (YES in the step S1209).

If a recording sheet key is pressed (YES in the step S1210), 1 is added to the variable K (step S1211), and it is determined whether the pressed recording sheet key is a recording sheet key K (step S1212).

If the pressed recording sheet key is not a recording sheet key K, the sequence proceeds to the step S1211 and this process is repeated (step S1212). It is thereby determined which key among recording sheet keys 1 to 6 has been pressed to select a recording sheet tray for a new print job.

After identification of the pressed recording sheet key in the above-mentioned steps S1211 and S1212, it is determined whether the flag KEY (K) corresponding to the identified recording sheet key K is 1 (step S1213). In other words, it is determined whether the pressed recording sheet key K has been selected for the registered print job already in the RAM 126.

If the pressed recording sheet key K has not been selected for the registered print job (NO in the step S1213), the input of this recording sheet key K is accepted, and the flag KEY (K) is set to the value of 1 which indicates that this flag KEY (K) is selected.

If the pressed recording sheet key K has been selected for the registered print job (YES in the step S1213) the input of this recording sheet key K is accepted, and the flag JOB (J) is set to 0 and the sequence proceeds to return (step S1214).

FIG. 15 is the system control processing subroutine.

First, it is determined whether there is print instruction for instructing operation starting to the set print job (step S1300). If there is no pint instruction (NO in the step S1300), other processes are operated and the sequence proceeds to return. (step S1305).

If there is a print instruction (YES in the step 1300), the print job number which is to be started is substituted in the variable J (step S1301), and it is determined whether the flag JOB (J) is 1 (step S1302).

The flag JOB (J) is the flag to be set to 1 if the same recording sheet tray as that for the print job registered previously is selected. Therefore herein, it is determined whether the recording sheet tray for the print job which is to be started now is the same as the recording sheet tray to be used for the print job registered previously.

If the recording sheet tray for the print job which is to be started now is not the recording sheet tray to be used for the print job registered previously (NO in the step S1302), the print job operation is started (step S1304).

Figure 17:
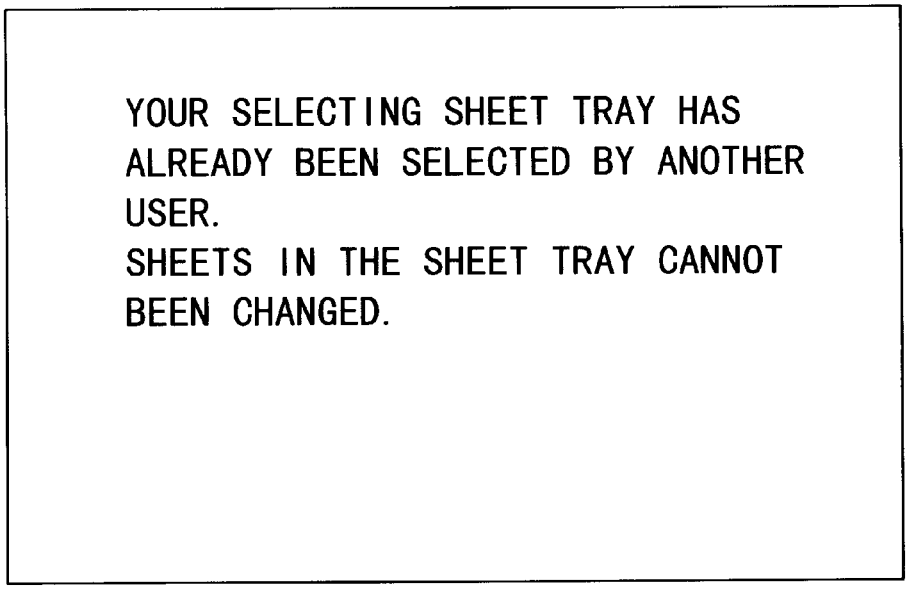
FIG. 17 is a picture of notice displayed in the case that a recording sheet tray of the print job to be printed is the recording sheet tray to be used for the print job which has been previously registered.

If the recording sheet tray for the print job which is to be started now is the recording sheet tray used for the print job registered previously (YES in the step S1302), the print job operation is brought to a stop temporarily before reading operation, and a notice as shown in FIG. 17 is displayed (step S1303).

The print job operation which has been brought to a stop is re-started after a prescribed time.

Thereby, selection of recording sheet tray for a new print job is accepted. If the print starting of a new print job is the print starting of the print job for which this previously selected recording sheet tray is selected, the operation is brought to a stop and a notice is given to a user to indicate that the recording sheet cannot be changed. If a user desires to change the recording sheet, the user changes the recording sheet by selecting other recording sheet tray.

In the above-mentioned embodiments 1 to 5, cases in which a document read by the image reading unit is printed have been described as the print job, however, alternatively the present invention is applied to the case in which the image data transmitted from personal computers through the network is printed. In this case, a signal for selecting a recording sheet tray is transmitted together with the image data, and the image forming apparatus which has accepted the signal selects a recording sheet tray correspondingly to the signal.

According to the invention described in claim 1, the recording sheet tray selected by the selection means for each registered print job is stored in memory respectively for each print job. When the recording sheet tray for a new print job is selected, selection of the recording sheet tray for the registered print job stored in memory is inhibited.

Thereby, the recording sheet tray which has been selected for the preceding print job is not selected for the subsequent print job.

As the result, recording sheets accommodated in the recording sheet tray selected in the preceding print job is not changed to other recording sheets to be used for the subsequent print job, and the preceding print job is printed always on the desired recording sheet.

In addition to the effect of the invention described in claim 1, according to the invention described in claim 2, keys corresponding to each recording sheet tray are displayed on a touch panel and the desired recording sheet tray is selected on the touch panel, a key for selecting the recording sheet tray for the registered print job is not displayed on the above-mentioned touch panel.

Thereby, selection of the recording sheet tray for the registered print job is inhibited consistently, and convenience for use by an operator is improved.

In addition to the effect of the invention described in claim 1, according to the invention described in claim 3, keys corresponding to each recording sheet tray are displayed on the touch panel to select the recording sheet tray, and the key for selecting the recording sheet tray for the registered print job is displayed differently from other keys for selecting corresponding to other recording sheet trays.

The difference in display allows an operator to recognize the recording sheet tray for the registered print job easily, and selection of the recording sheet tray which has been selected for the registered print job is inhibited consistently.

According to the invention described in claim 4, the recording sheet tray selected by the selection means for each registered print job is stored in memory for each print job.

When a recording sheet tray is selected for a new print job, if the second recording sheet tray has been stored in the above-mentioned memory as the recording sheet tray for the registered print job, selection of the second recording sheet tray for the new print job is inhibited.

Because the second recording sheet tray is a tray for feeding an arbitrary recording sheet and the selection of the second recording sheet tray is inhibited, recording sheets accommodated in the recording sheet tray which has been selected in the preceding print job will not be changed to another recording sheet to be used for the subsequent print job, and the preceding print job is always printed on the desired recording sheet.

According to the invention described in claim 5, the recording sheet tray selected by the selection means for each registered print job is stored in memory for each print job.

If the recording sheet tray selected for a new print job is the same as the recording sheet tray for the registered print job stored in memory, a notice is given to an operator. The notice allows the operator to recognize that the recording sheet tray which is wanted to be selected has been selected already for the registered print job, and recording sheets accommodated in the recording sheet tray to be selected will not be changed to another recording sheet.

As the result, the registered print job is always printed on the desired recording sheet.

According to the invention described in claim 6, the recording sheet tray which has been selected by the selection means for each registered print job is stored in memory for each print job.

When a recording sheet tray for a new print job is selected, if the second recording sheet tray is stored in the above-mentioned memory as the recording sheet tray for the registered print job, a notice that the second recording tray is selected for the new print job is given to an operator.

Because the second recording sheet tray is a tray for feeding an arbitrary recording sheet, the notice is given to an operator when the second recording tray is selected, and then the notice will be helpful to prevent misprinting that recording sheets accommodated in the recording sheet tray which has been selected in the preceding print job is changed to another recording sheet to be used for the subsequent print job, and the preceding print job is printed always on the desired recording sheet.

In addition to the effect of the invention described in claim 6, according to the invention described in claim 7, the recording sheet tray selected by the selection means for each registered print job is stored in memory for each print job.

In the case that the second recording sheet tray is selected as a recording sheet tray for a new print job, the second recording sheet tray has been selected already as the recording sheet tray for the registered print job, and the recording sheet having different size is used for the new print job and the registered print job, selection of the second recording sheet tray for the new print job is inhibited.

In other words, in the case that the second recording sheet tray has been already selected for the registered print job, selection of the second recording sheet tray is accepted only when recording sheets having the same size is used for the new print job. Because the second sheet tray is a recording sheet tray for feeding an arbitrary recording sheet, the recording sheet is possibly changed.

Therefore, because selection of the second recording sheet tray is accepted on condition that a recording sheet having the same size is used, recording sheets accommodated in the second recording sheet tray which has been selected for the preceding print job will not be changed to another recording sheet to be used for the subsequent print job, and the preceding print job is always printed on the desired recording sheet.

According to the invention described in claim 8, the recording sheet tray selected by the selection means for each registered print job is stored in memory for each print job. If the recording sheet tray which is the same as the recording sheet tray for the registered print job is selected for a new print job, operation for the new print job is brought to a stop.

An operator who wants to operate a new print job can recognize that the same recording sheet tray is selected for the registered print job.

Therefore, recording sheets accommodated in the recording sheet tray which has been selected for the preceding print job will not be changed to another recording sheet to be used for the subsequent print job, and the preceding print job is printed always on the desired recording sheet.

According to the invention described in claim 9, because the second recording sheet tray is the universal recording sheet tray for feeding recording sheets having various sizes, changing recording sheets accommodated in the universal tray to different recording sheets having various sizes is operated very often.

If the second recording sheet tray has been selected for the registered print job, control such as inhibition or notification is operated, thus the inconvenience associated with conventional methods is improved greatly.

According to the invention described in claim 10, the second recording sheet tray is provided with extension outside the image forming apparatus body, and because the second recording sheet tray is the hand feed recording sheet tray, which is used for feeding recording sheets having various sizes, changing recording sheets accommodated in the universal tray to different recording sheets having various sizes is operated very often.

Control such as inhibition or notification is operated if the second recording sheet tray has been selected for the registered print job, and thus the inconvenience associated with conventional methods is improved greatly.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An image forming apparatus for registering a plurality of print jobs in memory, reading out said registered print jobs, and printing on recording sheets, comprising:

a plurality of recording sheet trays for feeding recording sheets;

selection means for selecting a recording sheet tray used for each print job;

memory for storing identification information of the recording sheet tray which has been selected for each registered print job by said selection means; and control means for inhibiting selection of the recording sheet tray of which identification information has been already stored in said memory.

2. An image forming apparatus according to claim 1, wherein said selection means includes a touch panel for displaying keys corresponding to respective recording sheet trays, and said control means inhibits selection of the key for selecting the recording sheet tray by not displaying the key corresponding to said recording sheet tray of which the identification information has been already stored in said memory.

3. An image forming apparatus according to claim 1, wherein said selection means includes a touch panel for displaying keys corresponding to respective recording sheet trays, and said control means inhibits selection of the key for selecting the recording sheet tray by displaying the key, of which the identification information has been already stored in said memory, in a different manner from keys for selecting other recording sheet trays.

4. An image forming apparatus for registering a plurality of print jobs in memory, reading out said registered print jobs, and printing on recording sheets, comprising:

a first recording sheet tray for feeding pre-determined recording sheets;

a second recording sheet tray for feeding arbitrary recording sheets;

selection means for selecting a recording sheet tray to be used for each print job;

memory for storing identification information of the recording sheet tray which has been selected for each registered print job by said selection means; and control means for inhibiting selection of said second recording sheet tray, in case that identification information of said second recording sheet tray has been already stored in said memory.

5. An image forming apparatus according to claim 4, wherein said first recording sheet tray is a recording sheet tray for feeding recording sheets having a prescribed size, and said second recording sheet tray is a universal tray for feeding recording sheets having various sizes.

6. An image forming apparatus according to claim 4, wherein said first recording sheet tray is a recording sheet tray for feeding recording sheets having a prescribed size, and said second recording sheet tray has an extension outside the image forming apparatus body and is a hand feed recording sheet tray for feeding recording sheets having various sizes.

7. An image forming apparatus for registering a plurality of print jobs in memory, reading out said registered print jobs, and printing on recording sheets, comprising:

a plurality of recording sheet trays for feeding recording sheets;

selection means for selecting a recording sheet tray to be used for each print job;

memory for storing identification information of the recording sheet tray which has been selected for each registered print job by said selection means; and control means for issuing a notice in case that the recording sheet tray selected for a new print job by said selection means is the same as the recording sheet tray for the registered print job stored in said memory.

8. An image forming apparatus for registering a plurality of print jobs in memory, reading out said registered print jobs, and printing on recording sheets, comprising:

a first recording sheet tray for feeding pre-determined recording sheets;

a second recording sheet tray for feeding arbitrary recording sheets;

selection means for selecting a recording sheet tray to be used for each print job;

memory for storing identification information of the recording sheet tray which has been selected for each registered print job by said selection means; and control means for issuing a notice in case that said second recording sheet tray is selected as the recording sheet tray for a new print job by said selection means, and identification information of said second recording sheet tray has been stored in said memory as the recording sheet tray for the registered print job.

9. An image forming apparatus according to claim 8, wherein said first recording sheet tray is a recording sheet tray for feeding recording sheets having a prescribed size, and said second recording sheet tray is a universal tray for feeding recording sheets having various sizes.

10. An image forming apparatus according to claim 8, wherein said first recording sheet tray is a recording sheet tray for feeding recording sheets having a prescribed size, and said second recording sheet tray has an extension outside the image forming apparatus body and is a hand feed recording sheet tray for feeding recording sheets having various sizes.

11. An image forming apparatus for registering a plurality of print jobs in memory, reading out said registered print jobs, and printing on recording sheets, comprising:

a first recording sheet tray for feeding pre-determined recording sheets;

a second recording sheet tray for feeding arbitrary recording sheets;

selection means for selecting a recording sheet tray to be used for each print job;

memory for storing identification information of the recording sheet tray which has been selected for each registered print job by said selection means; and control means for inhibiting selection of said second recording sheet tray for a new print job in case that said second recording sheet tray is selected as the recording sheet tray for the new print job by said selection means, identification information of said second recording sheet tray has been stored in said memory as the recording sheet tray for the registered print job, and recording sheets having different sizes are used respectively for the new print job and the registered print job.

12. An image forming apparatus according to claim 11, wherein said first recording sheet tray is a recording sheet tray for feeding recording sheets having a prescribed size, and said second recording sheet tray is a universal tray for feeding recording sheets having various sizes.

13. An image forming apparatus according to claim 11, wherein said first recording sheet tray is a recording sheet tray for feeding recording sheets having a prescribed size, and said second recording sheet tray has an extension outside the image forming apparatus body and is a hand feed recording sheet tray for feeding recording sheets having various sizes.

14. An image forming apparatus for registering a plurality of print jobs in memory, reading out said registered print jobs, and printing on recording sheets, comprising:

a plurality of recording sheet trays for feeding recording sheets;

selection means for selecting a recording sheet tray to be used for each print job;

memory for storing identification information of the recording sheet tray which has been selected for each registered print job by said selection means; and control means for stopping operation for a new print job in case that said second recording sheet tray is selected as the recording sheet tray for a new print job by said selection means, and identification information of said second recording sheet tray has been stored in said memory as the recording sheet tray for the registered print job.

* * * * *